US011242626B2

(12) United States Patent
Engesser

(10) Patent No.: US 11,242,626 B2
(45) Date of Patent: Feb. 8, 2022

(54) NARROW FABRIC NEEDLE LOOM AND CORRESPONDING WEAVING METHOD

(71) Applicant: Textilma AG, Stansstad (CH)

(72) Inventor: Bernhard Engesser, Niederwil (CH)

(73) Assignee: Textilma AG

( * ) Notice: Subject to any disclaimer, the term of this patent is extended or adjusted under 35 U.S.C. 154(b) by 249 days.

(21) Appl. No.: 16/309,401

(22) PCT Filed: Jun. 12, 2017

(86) PCT No.: PCT/EP2017/064312
§ 371 (c)(1),
(2) Date: May 14, 2019

(87) PCT Pub. No.: WO2017/216117
PCT Pub. Date: Dec. 21, 2017

(65) Prior Publication Data

US 2019/0264355 A1 Aug. 29, 2019

(30) Foreign Application Priority Data

Jun. 15, 2016 (EP) ..... 16174607

(51) Int. Cl.
*D03D 47/04* (2006.01)
*D03D 47/08* (2006.01)
(Continued)

(52) U.S. Cl.
CPC ..... *D03D 47/04* (2013.01); *D03D 47/06* (2013.01); *D03D 47/08* (2013.01); *D03D 47/10* (2013.01)

(58) Field of Classification Search
CPC ..... D03D 47/04; D03D 47/10; D03D 47/06; D03D 47/08; D03D 41/00; D03D 31/00;
(Continued)

(56) References Cited

U.S. PATENT DOCUMENTS 1,296,024 A * 3/1919 Waite ..... D03D 35/00 139/431
3,064,689 A * 11/1962 Piazzolla ..... D03D 35/00 139/432
(Continued)

FOREIGN PATENT DOCUMENTS

CH 633 331 A 11/1982
EP 1526199 A1 8/2007
(Continued)

OTHER PUBLICATIONS

"Needle Weaving Technology in Narrow Fabrics Series of Text Books for the Narrow Fabrics Industry", vol. 2, Jakob Muller Institute of Narrow Fabrics.
(Continued)

*Primary Examiner* — Robert H Muromoto, Jr.
(74) *Attorney, Agent, or Firm* — George Pappas; Barrett McNagny

(57) ABSTRACT

A ribbon needle weaving loom including an electromechanic actuator for driving the weft thread insertion needle. A control device is provided and the actuator is configured—in co-operation with the control unit—in such manner as to allow preselection of the end position of the weft thread insertion needle at weft-insertion and of the position with retracted weft-insertion needle, and/or the starting time point of the motion of the weft-insertion needle and/or—the instantaneous speed of the motion of the weft-insertion needle, at least within a certain range. The electromechanic actuator is configured as rotary actuator or a linear actuator.

12 Claims, 15 Drawing Sheets

(51) Int. Cl.

| | |
|---|---|
| ***D03D 47/10*** | (2006.01) |
| ***D03D 47/06*** | (2006.01) |
| *D03D 41/00* | (2006.01) |

(58) Field of Classification Search
CPC ..... D03D 35/00; D03C 13/00; D03C 13/025; D03C 5/00
See application file for complete search history.

(56) References Cited

U.S. PATENT DOCUMENTS

| | | | | | |
|---|---|---|---|---|---|
| 3,104,683 | A * | 9/1963 | Weiner | D03D 35/00 | 139/431 |
| 4,305,434 | A * | 12/1981 | Muller | D03D 47/06 | 139/431 |
| 4,577,665 | A * | 3/1986 | Diesner | D03D 47/04 | 139/104 |
| 5,411,064 | A * | 5/1995 | Yamagishi | D03D 47/06 | 139/431 |
| 6,962,172 | B2 * | 11/2005 | Zorini | D03D 35/00 | 139/429 |
| 7,451,787 | B2 * | 11/2008 | Speich | D03D 35/00 | 139/22 |
| 10,526,731 | B2 * | 1/2020 | Podhajny | D03D 1/0088 | |
| 2007/0119142 | A1 * | 5/2007 | Buhler | D03C 13/00 | 57/1 R |
| 2013/0118633 | A1 * | 5/2013 | Studer | D03D 35/00 | 139/11 |
| 2018/0363170 | A1 | 12/2018 | Borer et al. | | |

FOREIGN PATENT DOCUMENTS

| | | | |
|---|---|---|---|
| EP | 2395140 | A1 | 12/2011 |
| EP | 3141642 | A1 | 3/2017 |
| WO | 2004092467 | A1 | 10/2004 |
| WO | 2007071077 | A1 | 6/2007 |
| WO | 2012163571 | A2 | 12/2012 |

OTHER PUBLICATIONS

English translation of International Search Report in related PCT/EP2017/064312.
English translation of Written Opinion of the ISA in related PCT/EP2017/064312.

* cited by examiner

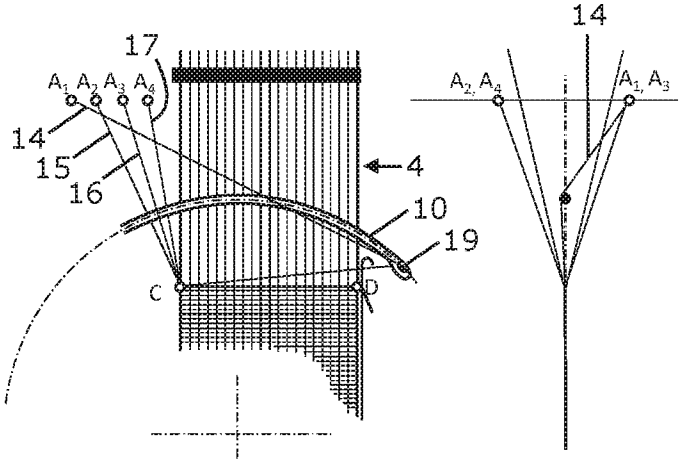
Fig.15a
Fig.15b
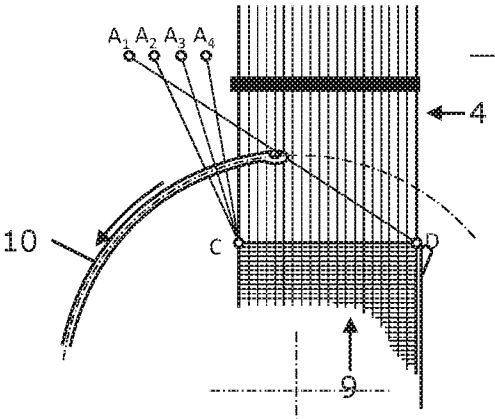
Fig.15c
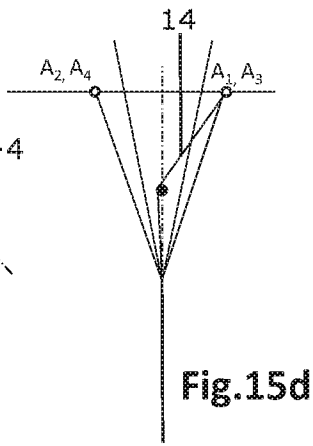
Fig.15d
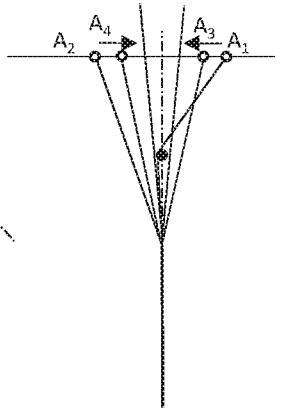
Fig.15f
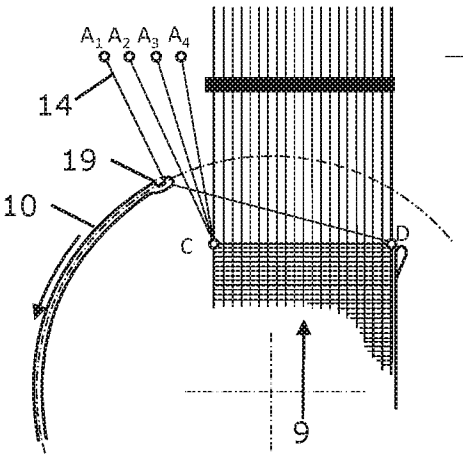
Fig.15e
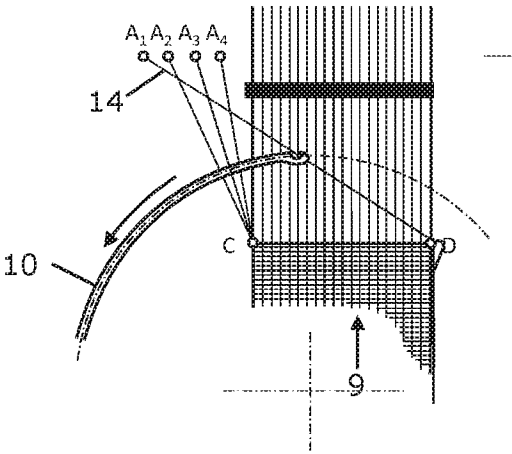
Fig.15g
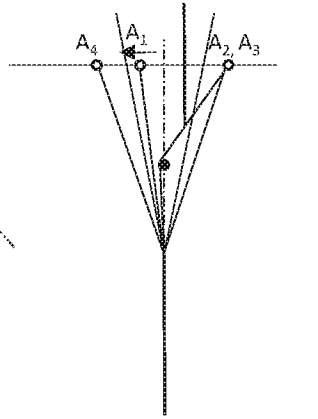
Fig.15h

NARROW FABRIC NEEDLE LOOM AND CORRESPONDING WEAVING METHOD

This application claims priority from PCT application No. PCT/EP2017/064312 filed Jun. 12, 2017 which claims priority from European application No. EP16174607.8 filed Jun. 15, 2016, the disclosures of which are incorporated herein by reference.

TECHNICAL FIELD

The invention relates to a ribbon needle weaving loom. Moreover, the invention relates to corresponding weaving methods.

BACKGROUND OF THE INVENTION

Ribbon needle weaving looms are used for weaving ribbons, usually with widths of up to approximately 40 cm, and they insert the weft thread into the open shed by means of a weft needle. Such a weaving loom, in which as usual the drive of the weft insertion needle is connected to the main shaft of the weaving loom by means of mechanical coupling, is known from CH 633 331 A. Thereby, it is essential that the weaving cycle, that means, the shed forming and the motion of the reed for the purpose of stopping the fabric, occurs synchronously with the weft insertion, for which purpose it has already been proposed, for example in WO 2004/092 467 A, that the shed forming may be provided, depending on the operating state of the weaving loom, with a "hard", i.e. strictly synchronized synchronization device, and with a "soft" synchronization device allowing for a certain degree of preceding or trailing of the shed forming. However, the weft insertion is always provided as "hard" synchronization also with the just mentioned weaving looms because the weft needle must always find an open shed for its entire insertion time. Thereby, weft insertion needles of a ribbon weaving loom usually make a crescent-shaped motion, which—as described in CH 633 331 A—originates from the reciprocating pivoting motion derived from the main shaft. However, for certain applications, this type of weaving loom wherein the drive of the weft insertion needle is derived from the main shaft of the weaving loom reaches certain limits. Such type of application is the production of ribbons with varying bandwidth. In such a weaving loom, the transition from a larger width to a smaller width and vice versa results in unappealing weave regions, which are perceived as flawed by the person skilled in the art, if the weft needle always travels along the same weft insertion path independently of the width of the woven ribbon. This is because—particularly in the transition region between a larger to a smaller and from a smaller to a larger ribbon width—the weft thread tension cannot be kept constant in a simple manner. In another typical application with ribbon needle weaving looms, in which the conventional crescent technique is used wherein the weft needle motion is more or less rigidly driven by the main shaft, various weft threads—typically threads with different colors, but also threads with different material properties—are selected by a single weft needle. Also here it seems problematic to maintain a uniform weft thread tension for the different threads, which in fact are picked up from different positions. In certain applications of ribbon needle weaving looms, the starting time of the weft needle insertion motion is furthermore particularly critical. This is the case, on the one hand, for example in a stitch-like insertion of an additional thread such as an antenna thread according to EP 2395140 A1 or WO 2007/071077 A1, or of an effect thread such as in EP 3141642 A1, and on the other hand, also quite generally, when the warp threads cannot be separated quickly enough during a change of the shed so that the weft insertion cannot be carried out precisely during the change of the shed. The latter problem could actually be solved, in principle, with an increased shed stroke or with a significantly reduced weaving speed; but this solution is partly undesirable for various reasons. A generic ribbon needle weaving loom is, furthermore, described in EP 1526199 A1.

SUMMARY OF THE INVENTION

The object of the invention is to configure a weft insertion in a ribbon needle weaving loom in such manner that the path of the weft insertion needle as well as the starting time point of the weft insertion can be varied as freely as possible without the requirement of complex transmission arrangements between the main shaft and the driving of the weft insertion needle.

This object is achieved by a ribbon needle weaving loom as described herein. Thereby, the measures of the invention initially lead to an unexpectedly high level of flexibility. Due to the fact that the control unit for controlling the driving motors for the weft insertion needle is configured in such manner that the targeting of a predetermined insertion end position and a return end position of the weft insertion needle can be selected in practically free manner for each weft insertion, an optimal insertion path of the weft needle is programmable for each one of varying bandwidths, wherein, for example, upon transition to another width of the woven ribbon the weft thread tension can be kept uniform. The problem arising with different weft threads to be selectively picked up by the weft needle is solved by the measures of the invention in the same or a similar manner. It is apparent that with a weft insertion actuator which is programmable by the control unit, either as a rotary drive or as a linear drive, also the starting time point and also the insertion speed, not only the path of the weft insertion needle, can be predetermined. In particular, with additional threads that are inserted into the woven material by means of reed hooks or the like, the critical edge conditions can be taken into consideration. In the present context, the term "weft thread loop" shall designate the section of the weft thread which is to be incorporated from the insertion side all the way to the knitting device and back into the warp threads.

The electromechanic actuator of the ribbon needle weaving loom according to the present invention can advantageously be configured as a rotary drive, preferably as servo motor or as stepper motor, whereby the weft insertion needle is firmly connected to the axis of the rotary actuator through a band or pulley drive or through a crank drive. For this purpose, the rotary actuator can either execute the motion of a vibration in form of a motion back and forth about a certain angle and thus be connected with the weft thread insertion needle directly or, for example, through a band or pulley drive (for example, as a transmission gear or reducing gear) or it can execute a complete circular motion and then, for example, execute the motion of the weft thread insertion needle through a crank drive. It is particularly advantageous—at least for certain applications—if the electromechanic actuator is configured as a linear drive—also preferably as a servo motor or stepper motor. In this case, it is possible to have, instead of the crescent path generally used for weft insertion needles, a straight i.e. geometrically short weft insertion needle path—preferably aligned perpendicularly to the warp threads. In this case, it can be provided—as a rigid, but simplest solution—that the weft thread insertion needle is firmly connected to the lifting axis of the linear actuator, alternatively through a band or pulley drive or by means of a pushrod, toothed rack, pinion or a lever drive. Indeed, the latter embodiments are particularly advantageous when the drive is connected to a plurality of synchronized ribbon weaving units, which are preferably arranged adjacent to each other, each having one weft thread insertion needle. To relieve the actuator, it may be advantageous if the actuator and the weft thread insertion needle form together with the two restoring springs of a restoring spring arrangement a spring/mass system. It may be advantageous if the ribbon needle weaving loom comprises means for producing a ribbon with varying width, wherein such means may comprise, in particular, Y-shaped reeds which are preferably adjustable in height. It can be advantageous if the ribbon needle weaving loom comprises means for picking up and depositing weft threads of various type, for which purpose advantageous means are described, for example, in WO2012/163571 A2. The aforementioned elements as well as those claimed and described in the following exemplary embodiments, to be used according to the invention, are not subject to any particular conditions by way of exclusion in terms of their size, shape, use of material and technical design, with the result that the selection criteria known in the respective field of application can be used without restrictions.

BRIEF DESCRIPTION OF THE DRAWINGS

Further details, advantages and features of the object of the present invention will become apparent from the following description and the corresponding drawings, in which ribbon needle weaving looms and their weft thread insertion units according to the present invention are illustrated by way of example. In the drawings there are shown in.

DETAILED DESCRIPTION OF THE PREFERRED EMBODIMENTS OF THE INVENTION

Figure 2:
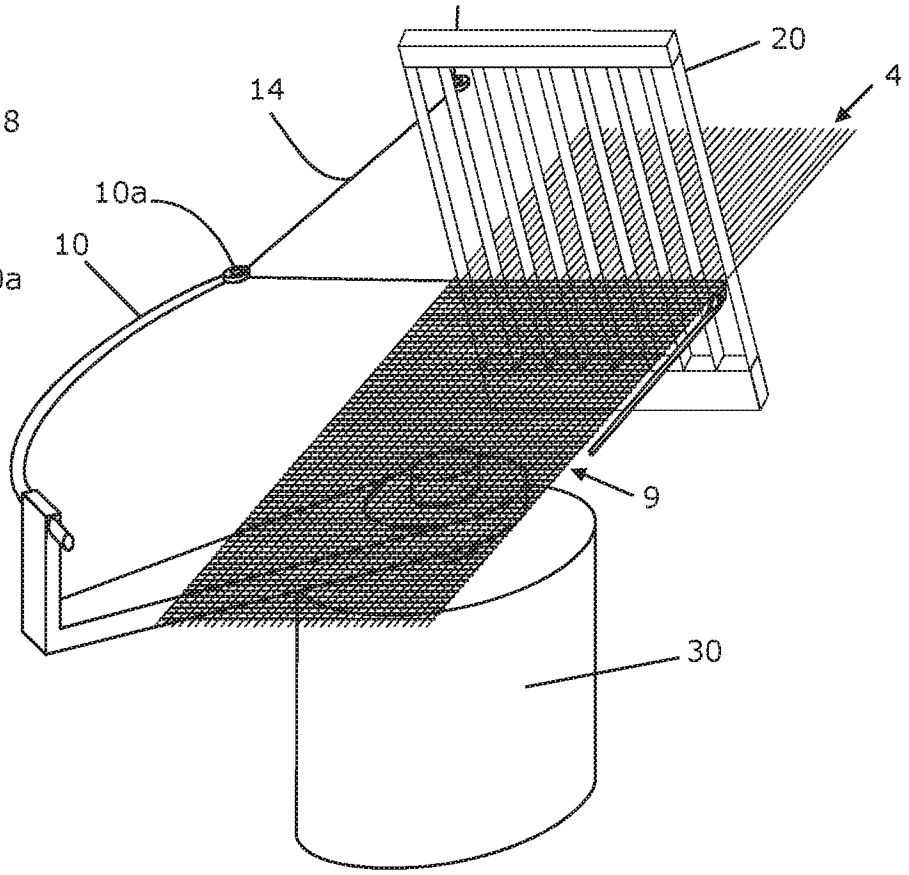
FIG. 2 a weft thread insertion unit according to the embodiment in FIG. 1, in the position "reed beat-up"
Figure 1:
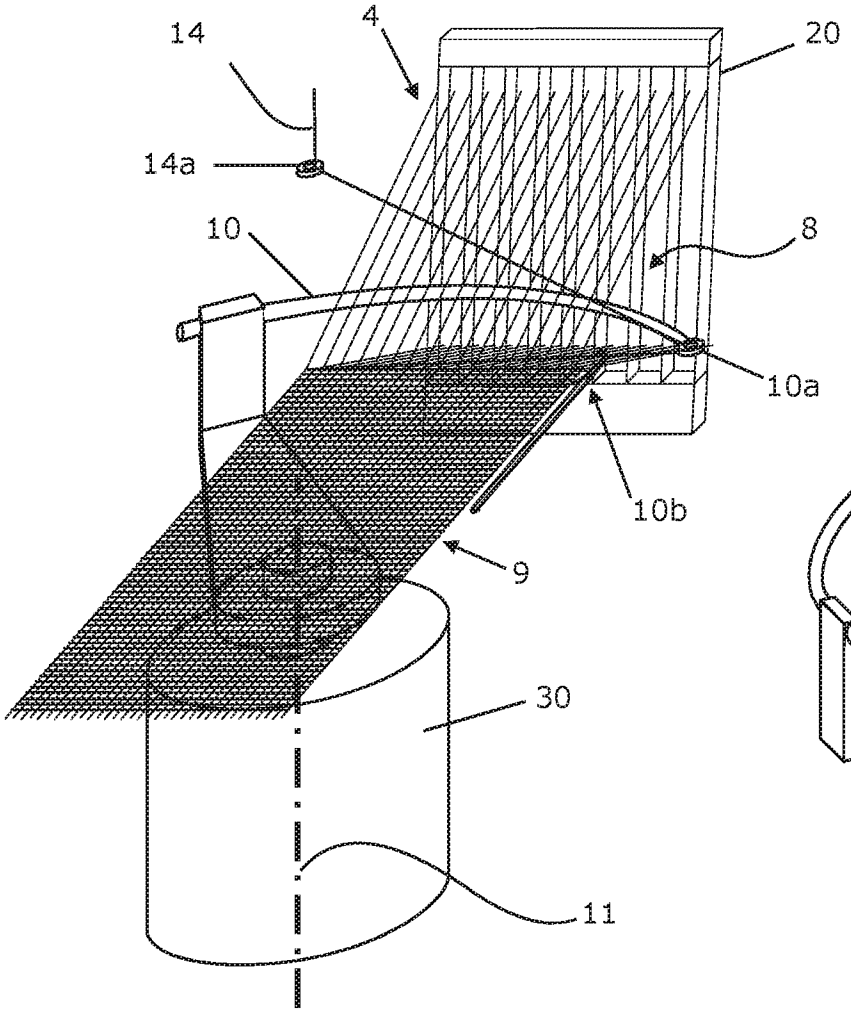
FIG. 1 a weft thread insertion unit according to a first embodiment of the invention with a rotary actuator directly connected to the weft insertion needle, in the position "open shed"
Figure 4:
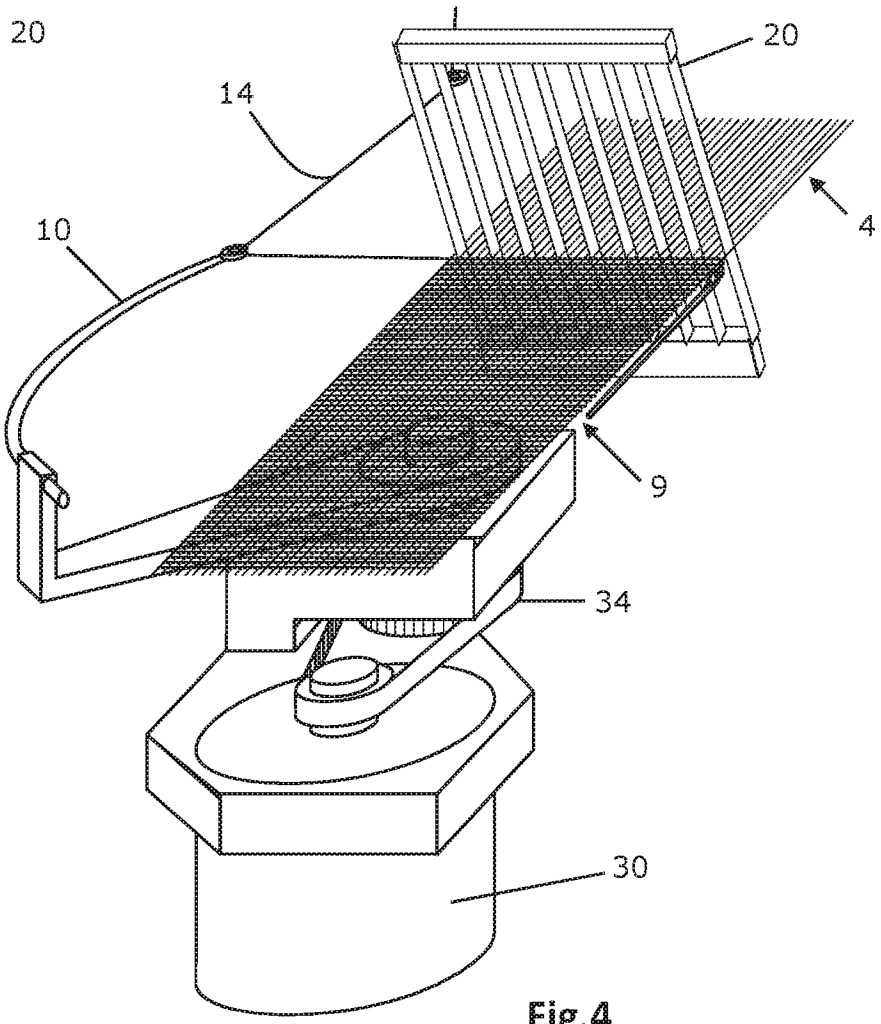
FIG. 4 a weft thread insertion unit according to the embodiment in FIG. 3, in the position "reed beat-up"
Figure 3:
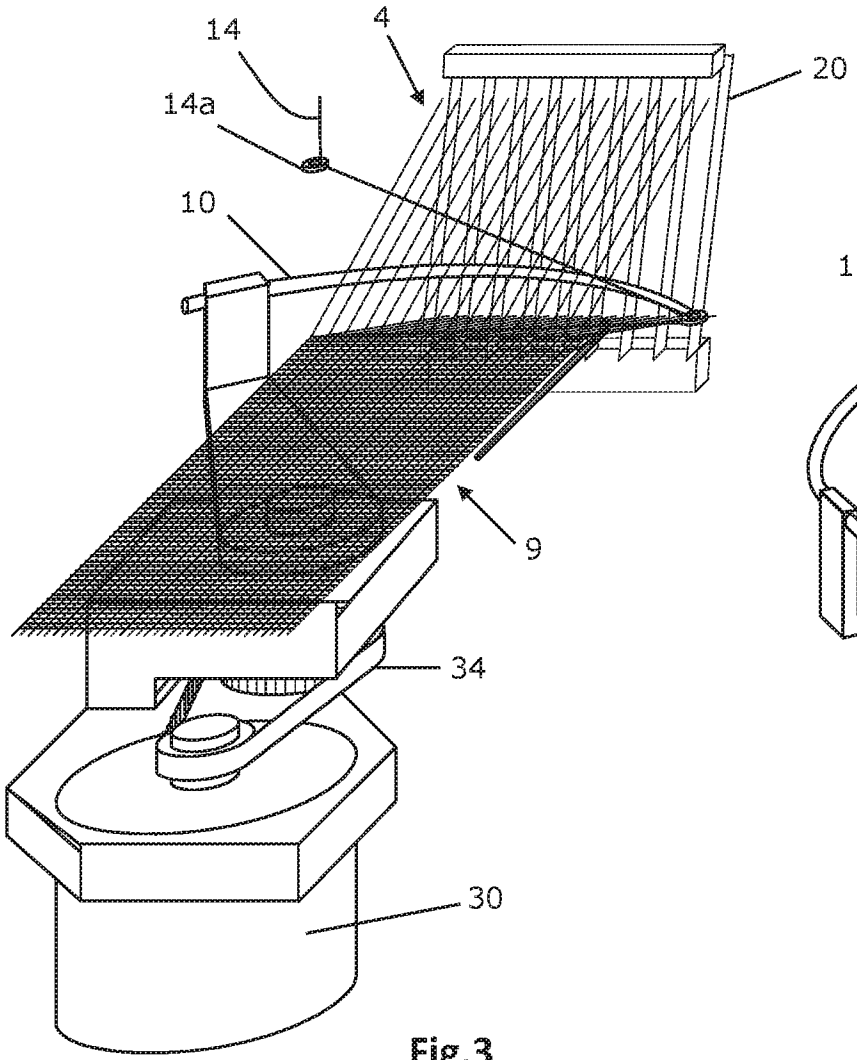
FIG. 3 a weft thread insertion unit according to a second embodiment of the invention with a rotary actuator connected to the weft insertion needle by means of a toothed belt, in the position "open shed"
Figure 6:
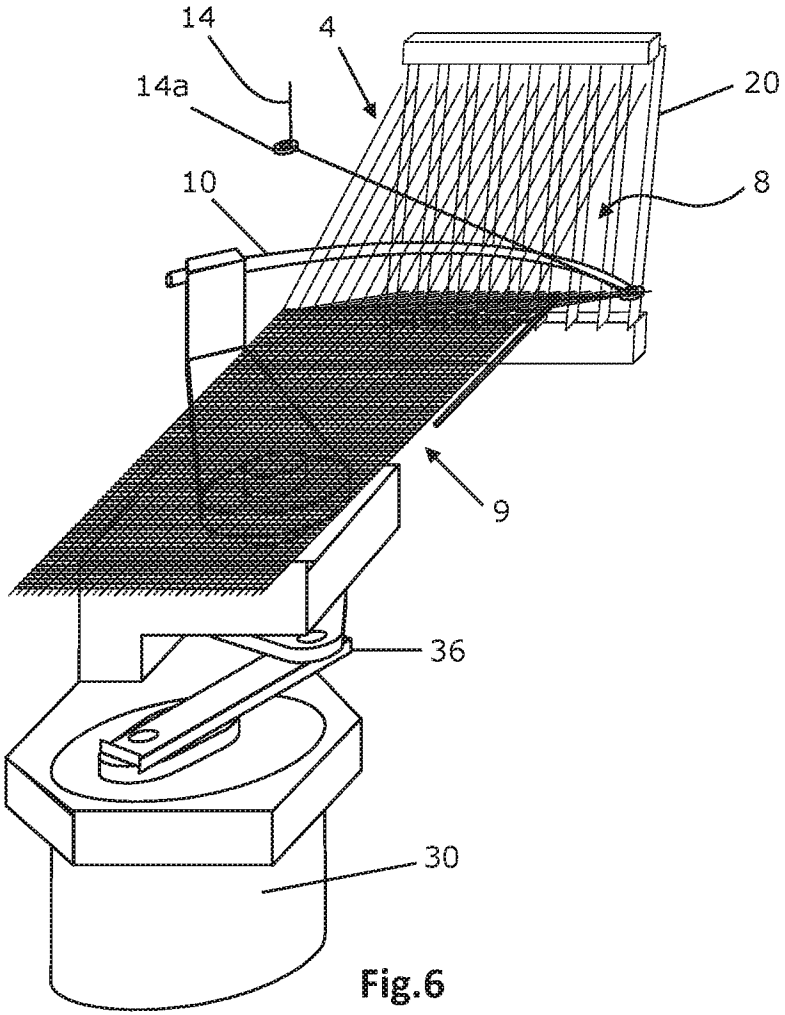
FIG. 6 a weft thread insertion unit according to the embodiment in FIG. 5, in the position "open shed"
Figure 5:
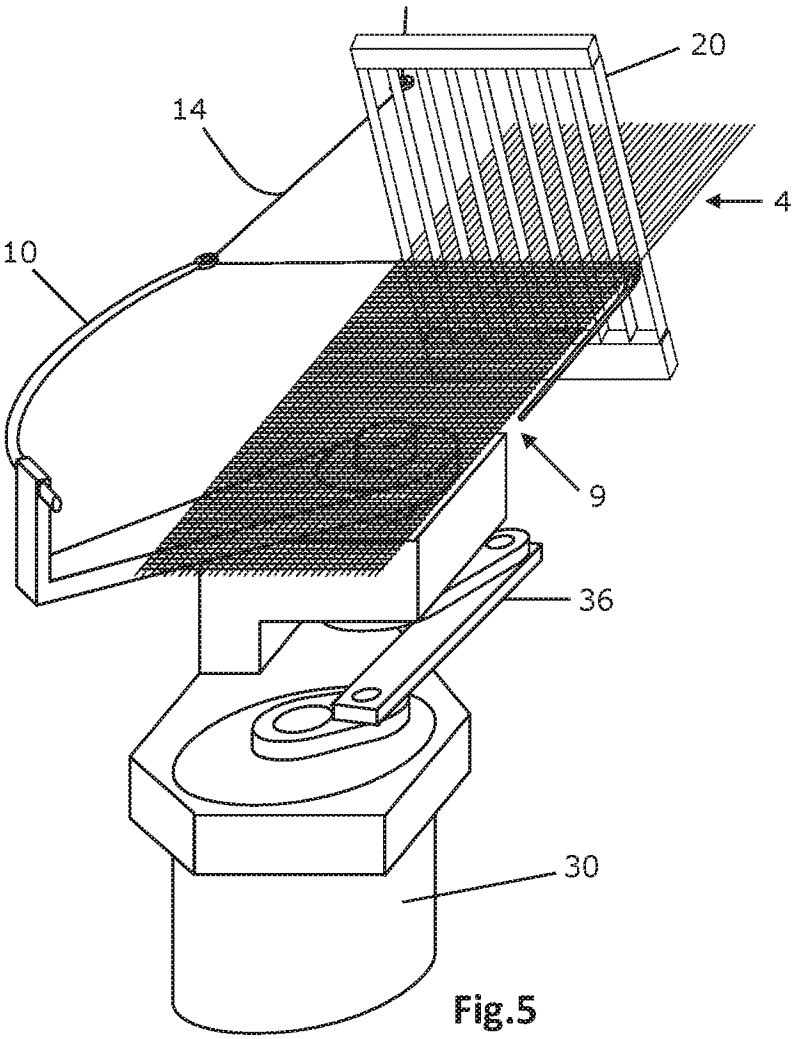
FIG. 5 a weft thread insertion unit according to a third embodiment of the invention with a rotary actuator connected to the weft insertion needle by means of a crank drive, in the position "reed beat-up"
Figure 7:
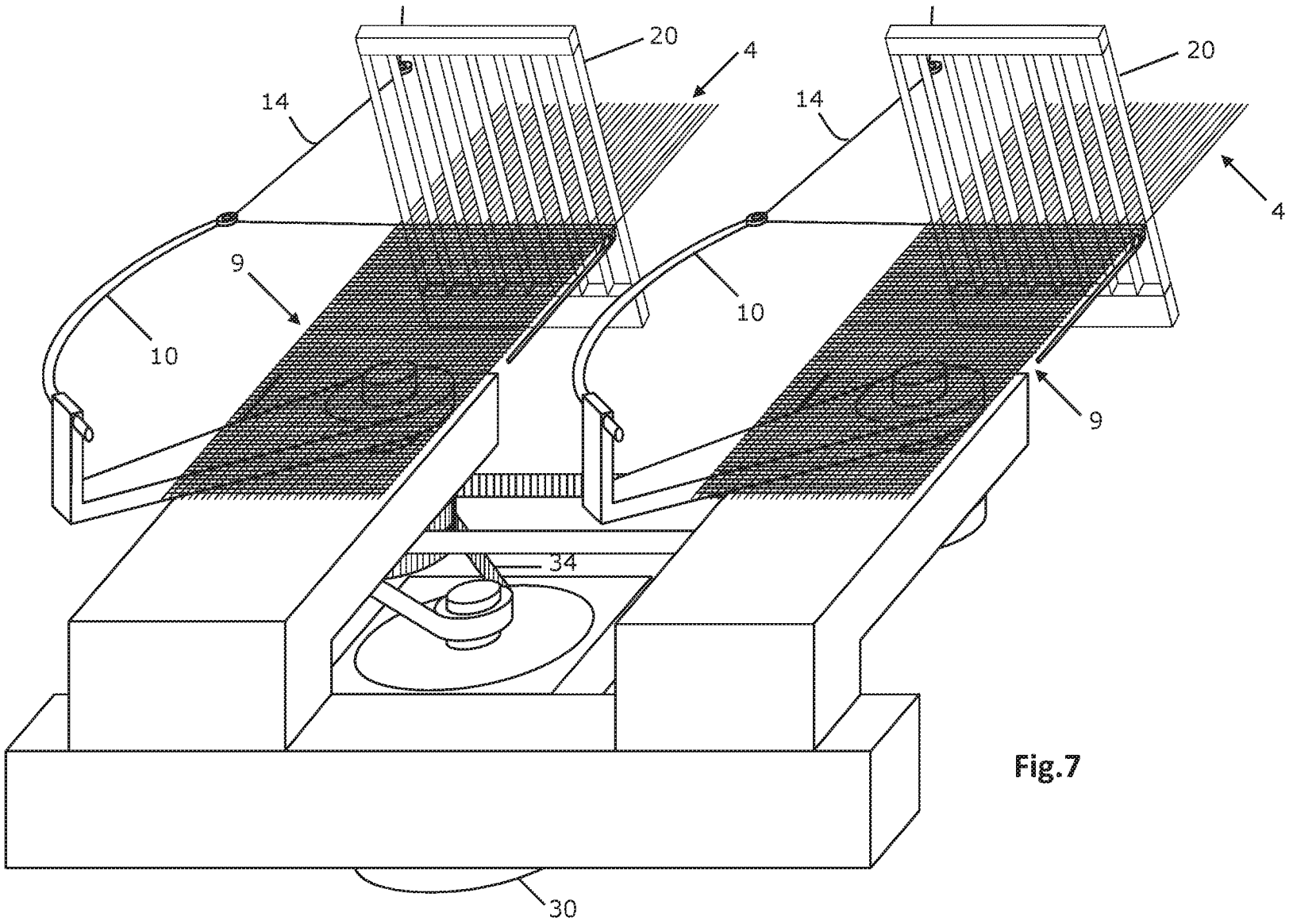
FIG. 7 a weft thread insertion unit according to a further embodiment of the invention with a rotary actuator connected to a plurality of weft insertion needle by means of a toothed belt, in the position "reed beat-up"
Figure 8:
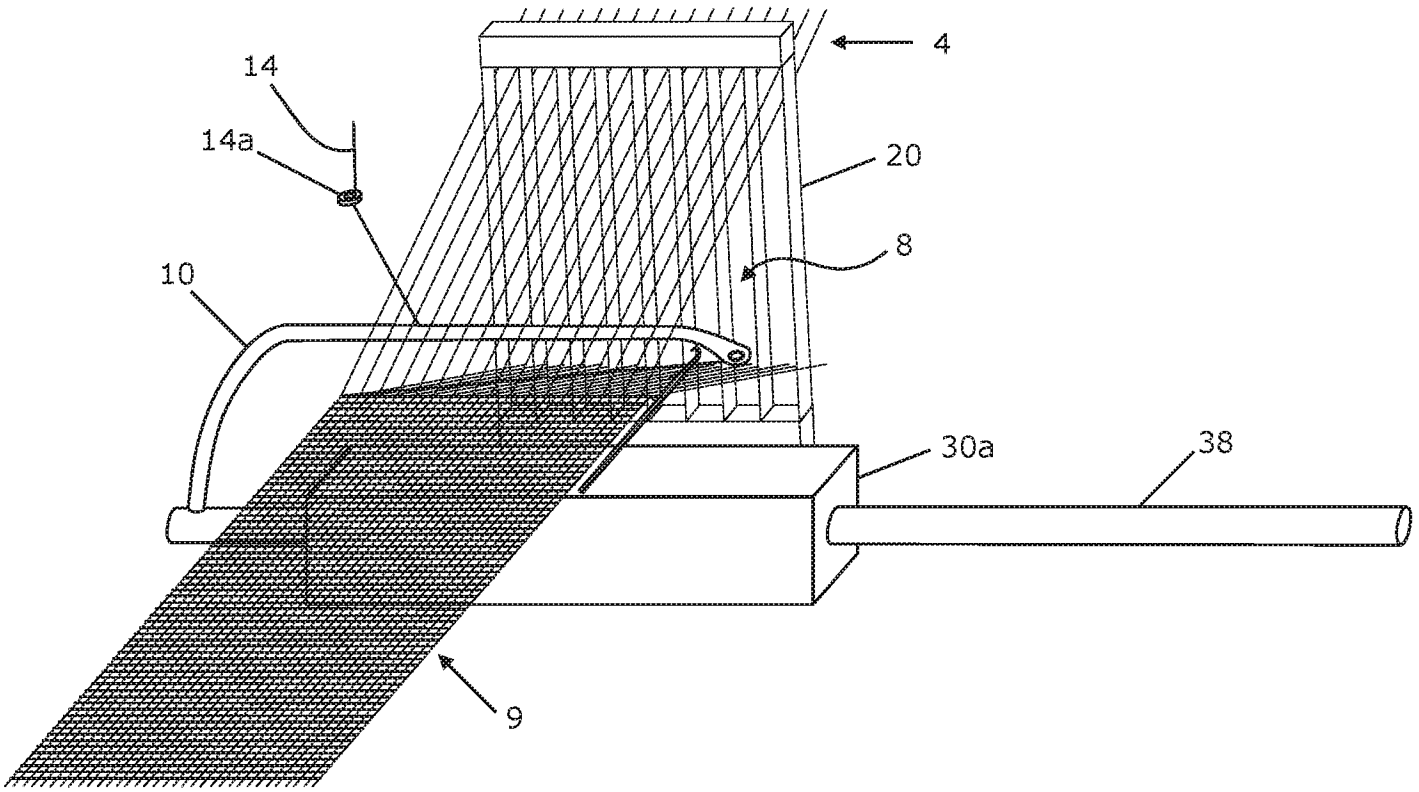
FIG. 8 a weft thread insertion unit according to an alternative embodiment of the invention with a linear actuator directly connected to the weft insertion needle, in the position "open shed"
Figure 9:
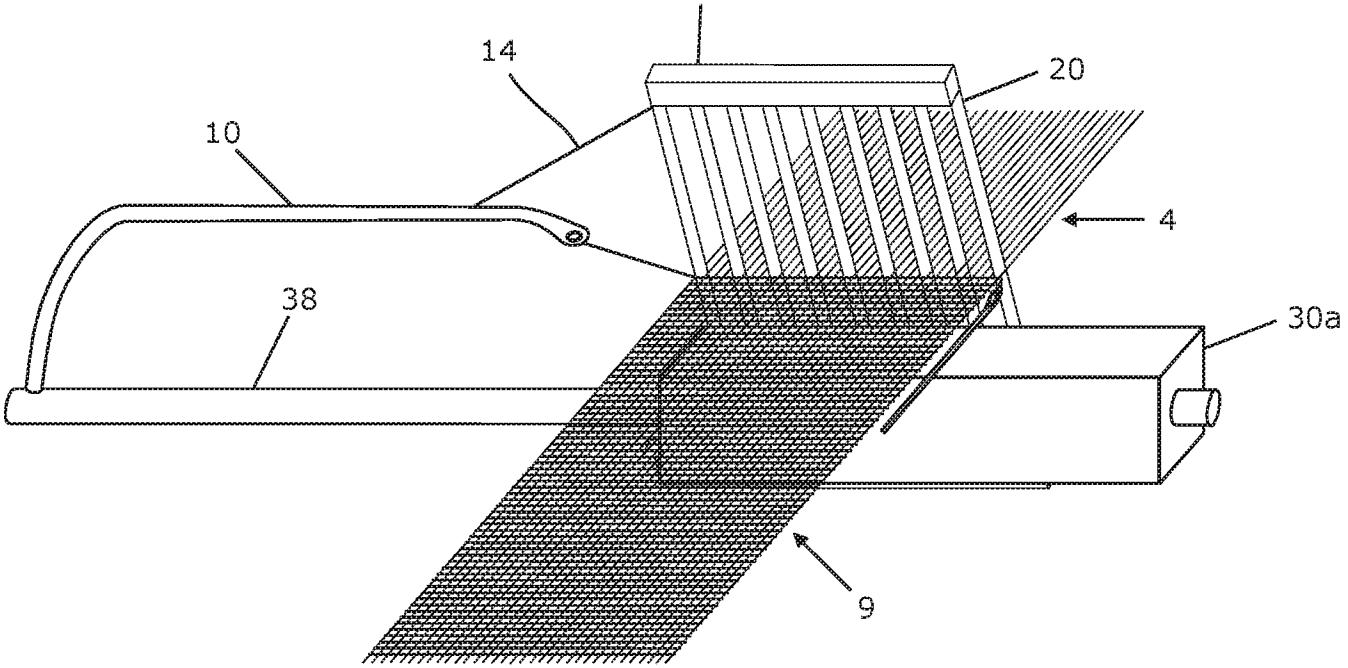
FIG. 9 a weft thread insertion unit according to the embodiment in FIG. 9, in the position "reed beat-up"
Figure 10:
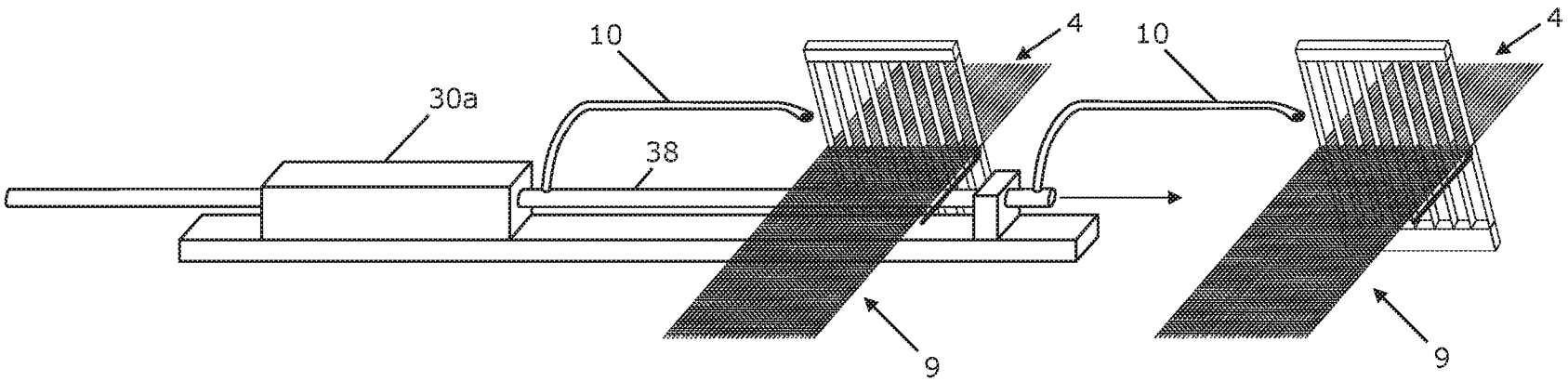
FIG. 10 a weft thread insertion unit according to a further embodiment of the invention with a linear actuator connected to a plurality of weft insertion needles by means of a pushrod, in the position "reed beat-up"
Figure 11:
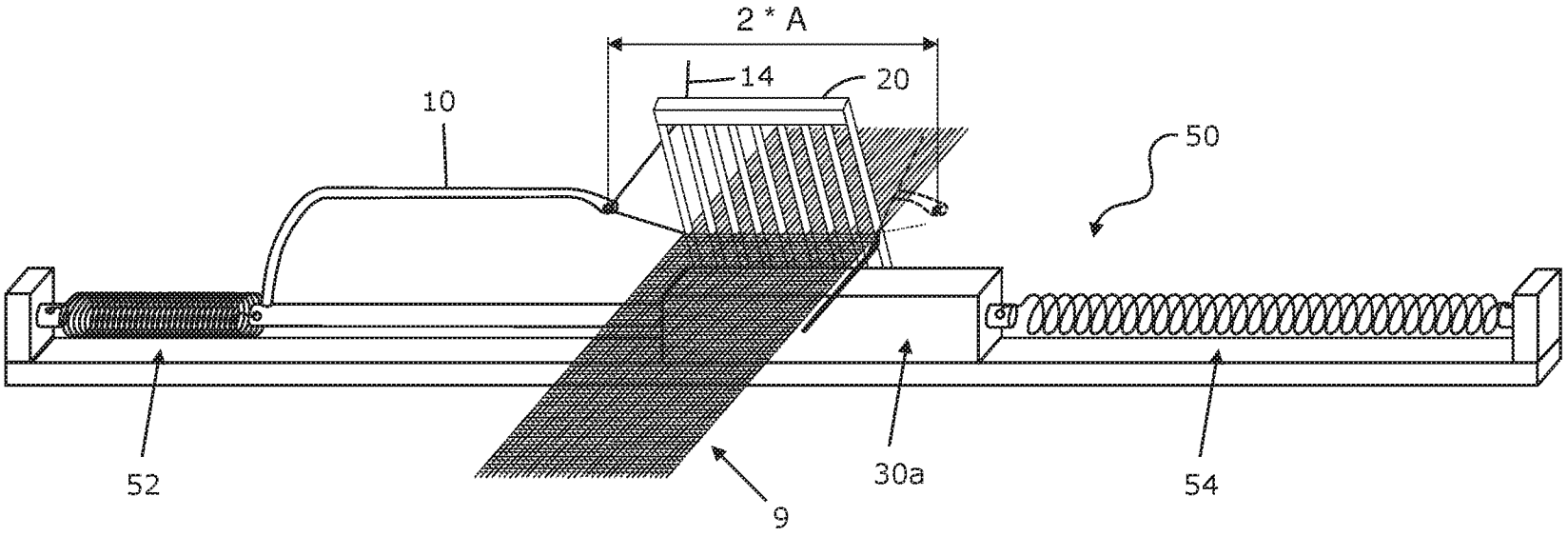
FIG. 11 a weft thread insertion unit according to a further embodiment of the invention, in which the actuator and the weft thread insertion needle form, together with a restoring spring arrangement, a spring/mass system.

In FIGS. 1 and 2, there is shown a first embodiment of the present invention by means of the essential elements. In the position "open shed" (FIG. 1), a weft thread insertion needle 10 is inserted into the open shed 8 with warp threads 4 by means of a rotary actuator 30 directly connected to the weft insertion needle 10, while in the position "reed beat-up" (FIG. 2) the weft thread insertion needle 10 is removed from the woven material 9 by means of the rotary actuator 30, the reed 20 is stopped against already woven material 9 and the shed 8 is closed. It will readily be understood that the rotary actuator will execute an oscillating motion in the present case. A comparison of these two figures shows that each weft thread forms a respective weft thread triangle between the weft thread guiding eye 14*a*, the last weft thread loop 10*b* and the thread receiving 10*a* at the weft thread insertion needle 10 in the two positions shown. In the case of a single weft thread shown here, the thread receiving 10*a* is also an eye. This triangle, which in each case degenerates to a line at a certain position of the weft thread insertion needle 10 in the shed 8, will be the subject of further discussion of the present invention and its execution. First, however, certain variations to the embodiments shown in FIGS. 1 and 2 shall be described. In the FIGS. 3 and 4, the direct drive has been replaced by a toothed belt of a band or pulley drive 34. This can have reasons regarding a certain, advantageous transmission or reducing ratio, that is, in the configuration of the rotary actuator 30, or else regarding the available spatial conditions. Again, the rotary actuator 30 will execute an oscillating motion. In the FIGS. 5 and 6, the direct drive has been replaced by a crank drive 36. In this case, the rotary actuator 30 can be set up and operated so that it cannot execute an oscillating motion, but a circular motion. In FIG. 7, there is shown a weft thread insertion unit according to a further developed embodiment of the invention with a rotary actuator 30 connected to a plurality of weaving units, which are arranged adjacent to each other, each having one weft thread insertion needle 10, by means of a pulley drive 34 with toothed belts, in the position "reed beat-up". However, the rotary actuator 30—as shown in FIGS. 8 to 10—can be replaced by a linear actuator 30*a*. FIG. 8 shows such a weft thread insertion unit with a linear actuator 30*a* directly connected to a plurality of weft insertion needles by means of a pushrod in the position "reed beat-up", and in FIG. 9 in the position "reed beat-up". FIG. 10 shows a weft thread insertion unit with a linear actuator 30*a* connected to a plurality of weft insertion needles 10 by means of a pushrod 38, in the position "reed beat-up". In FIG. 11, there is shown an embodiment in which the actuator 30*a* and the weft thread insertion needle 10 form, together with the two restoring springs 52 and 54 of a restoring spring arrangement 50, a spring/mass system. If the latter is displaced by a path A from the equilibrium position and then released, it oscillates in its natural frequency $\omega_0$. The shape of motion corresponds to a pure sine curve:

$$s(t)=A*\sin(\omega_0*t)\quad A=\text{oscillation amplitude } [m],\ t=\text{time } [\text{sec}]$$

Frictional forces dampen the vibration, so that it subsides and finally comes to a standstill. The natural frequency substantially depends on the moving mass and the spring constant and is calculated according to the formula:

$$\omega_0^2=c/m\quad c=\text{spring constant } [N/m],\ m=\text{total moving mass } [\text{kg}]$$

Ideally, the system is tuned such that the frequency of the main shaft rotation in the production mode coincides with the natural frequency of the weft insertion system. The linear actuator 30*a* then only has to overcome the frictional forces and to correct small frequency deviations. In this way, a very low-energy operation of the weft insertion system is possible. As soon as the main shaft rotational frequency falls below the natural frequency of the weft insertion system and/or the shape of the motion of the weft insertion system shall deviate from the pure sine curve, the linear actuator must apply higher forces for the synchronization of the motions because it must counteract or support the natural frequency. Provided that the friction in the vibration system is not excessive, the maximum force to be applied by the linear actuator $F_{max}=c*A$ occurs when the weft needle must be held in one of its end positions when the machine is stopped.

Figure 12B:
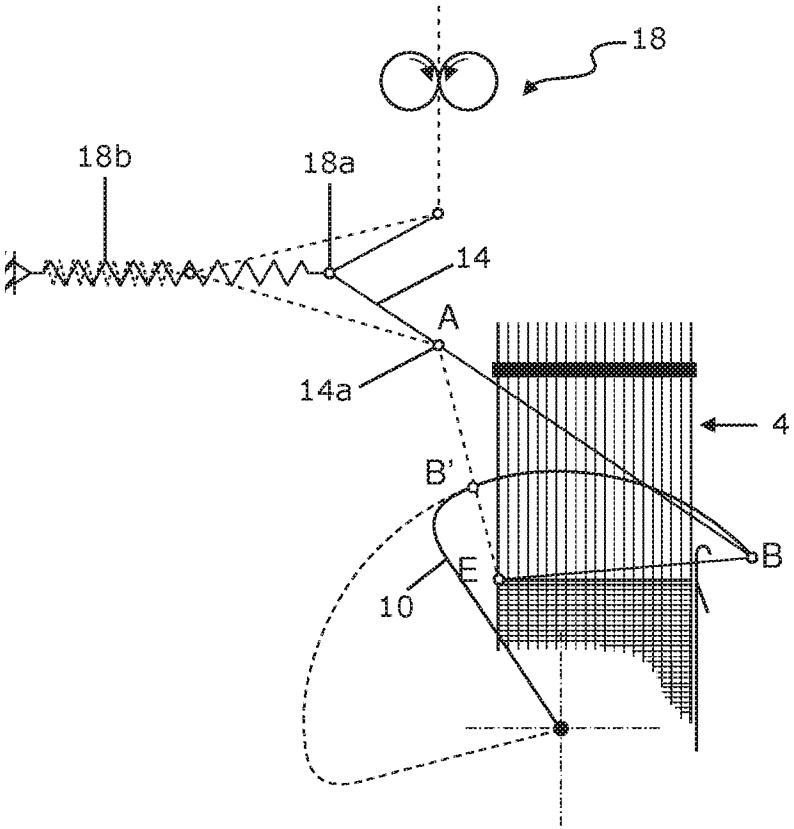
FIG. 12*b* the tension situation of the weft thread (weft thread triangle) according to FIG. 8 at the right turning point.
Figure 12A:
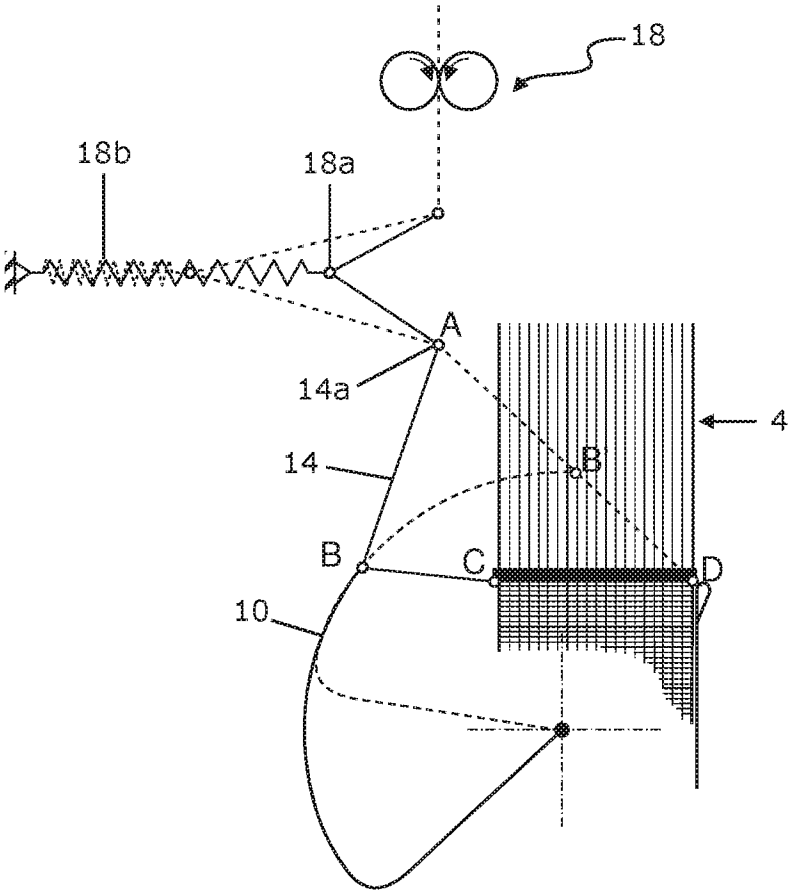
FIG. 12*a* the tension situation of the weft thread (weft thread triangle) according to FIG. 1 at the left turning point.
Figure 13B:
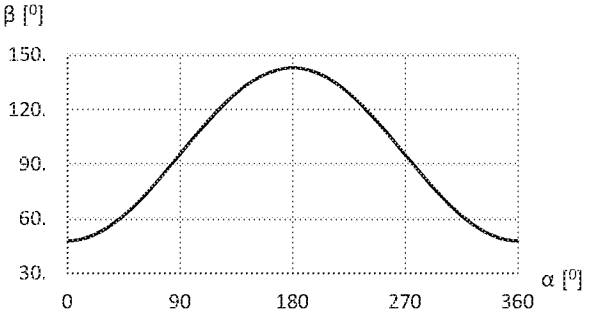
FIG. 13*b* the diagram of the weft thread position ($\beta$) over the phase ($\alpha$) of the weaving process (main shaft), FIG. 13*c* the diagram of the weft thread consumption over the phase ($\alpha$) of the weaving process (main shaft), and FIG. 13*d* the diagram of the weft thread tension ($F_s$) over the phase ($\alpha$) of the weaving process (main shaft)
Figure 13C:
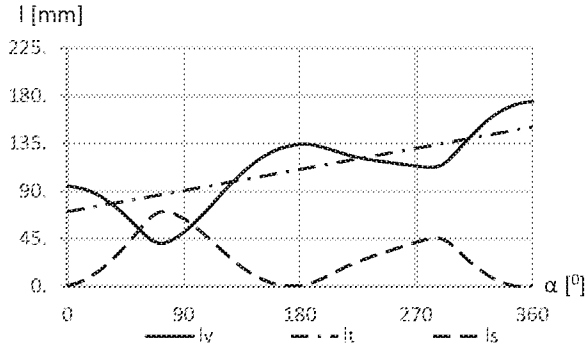
FIG. 13*a* the weft thread feed situation at different locations.
Figure 13D:
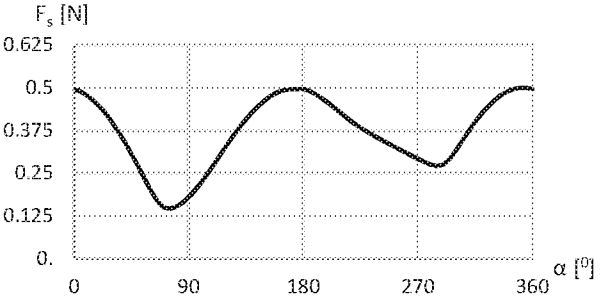
Figure 13A:
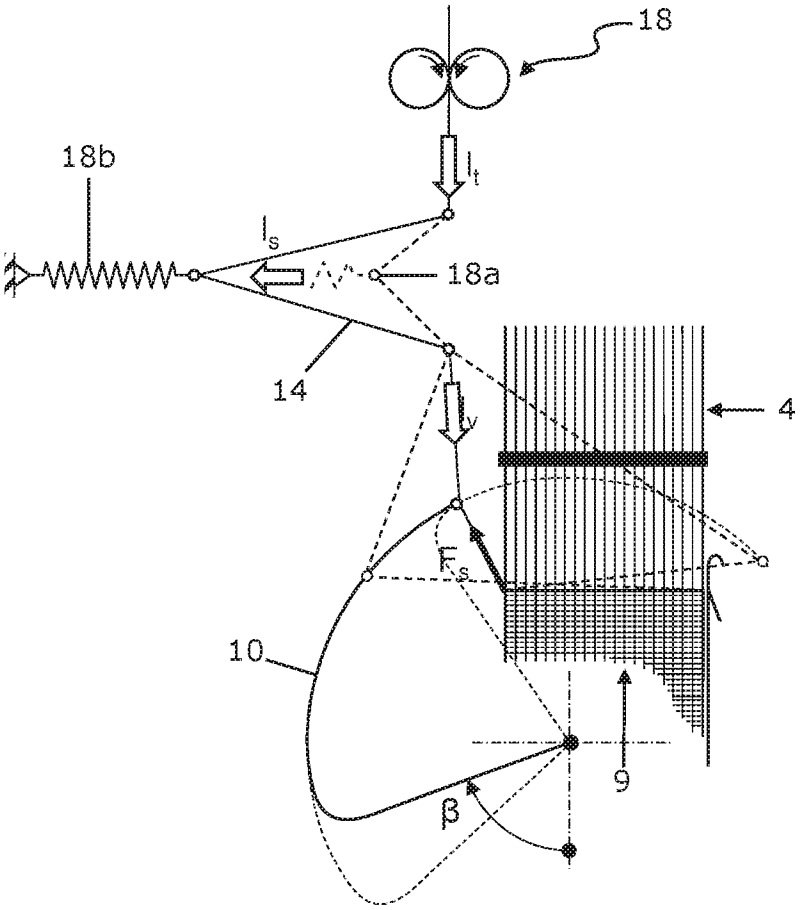

In FIGS. 12*a* and 12*b*, the above-mentioned weft thread triangle will now be explained. The weft thread 14 is feed to the weft thread guiding eye by means of the weft thread transport means 18 via the eye 18*a* and the weft thread tension spring 18*b*. In FIG. 12*a*, there is shown the weft geometry during the motion of the weft thread insertion needle 10 out of the shed. The minimum weft tension occurs when the weft thread eye (at position B) crosses the line segment A (position of the weft thread guiding eye 14*a*)-D (position of the knitting of the weft thread 14 at the right ribbon edge) at the point B', that is where the triangle degenerates to a line. The maximum weft thread tension, on the other hand, occurs when the weft thread insertion needle 10 reaches the left turning point or stops at the reed. From the difference of the distances A-B-C-D to the distance A-D there results the extent of this maximum tension. In FIG. 12*b* there is shown the contrasting situation of the weft thread geometry during the motion of the weft needle into the shed. The minimum weft thread tension occurs when the weft thread eye crosses the line segment A-E (with E as the position of the left ribbon edge). The maximum weft thread tension occurs when the weft needle reaches the right turning point. The difference of the distances A-B-E to the distance A-E here pertains to the extent of this maximum tension. The situation of the weft thread feed at various positions, namely $I_t$ behind the weft thread transport means 18, $I_s$ at the weft thread tension spring 18*b* and $I_v$ next to the weft thread guiding eye 14*a*, is shown geometrically in FIG. 13*a* and as a diagram above the phase angle of the weaving cycle (main shaft) in FIG. 13*c*. The corresponding weft needle position β results from the diagram of FIG. 13*b* and the tension $F_s$ from the diagram of FIG. 13*d*.

This situation is now accessible to the improvements of the present invention, which will be shown in various applications.

Figure 14A:
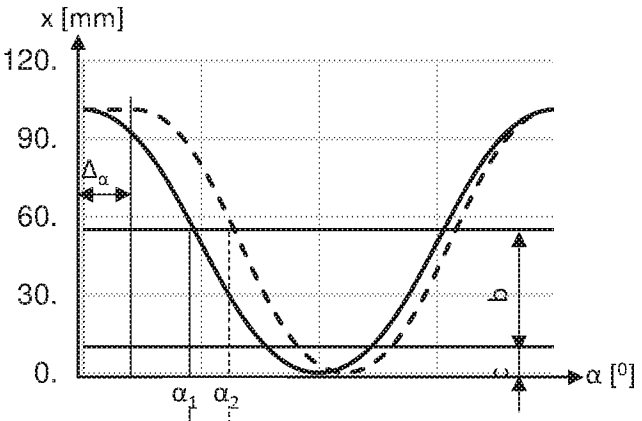
FIG. 14*a* the diagram of the weft needle position (x)—relative to the right-end point—over the phase ($\alpha$) of the weaving process (main shaft) with a delayed thread insertion of the weft insertion needle and FIG. 14*b* the diagram of the shed opening ($\xi$) over the phase ($\alpha$) of the weaving process with the "normal" shed insertion phase angle ($\alpha_1$) and with the delayed thread insertion phase angle ($\alpha_2$) of the weft needle according to FIG. 14*a;*
Figure 14B:
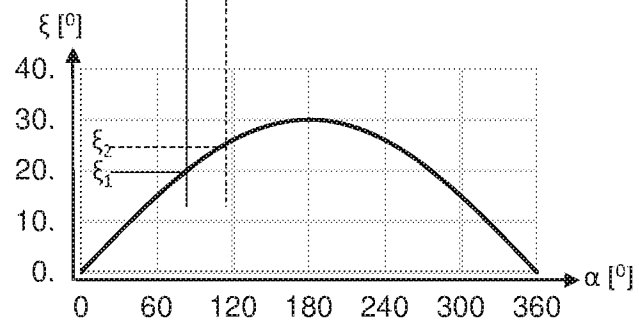

As a first application example, the delayed shed insertion angle of the weft thread insertion needle 10 will be explained with reference to FIGS. 14*a* and 14*b*. If the weft thread insertion needle 10 at the point $\alpha_2/\xi_2$ inserts into the shed 8 later than the normal insertion $\alpha_1/\xi_1$, the shed is already opened further. This is advantageous for warp threads that tend to cling. The farther the shed opens, the higher the warp thread tension and the sooner the cling of the upper and lower shed threads is released. Moreover, in the case of a delayed insertion of the weft thread insertion needle 10 into the shed 8, more time is available.

In the end, the security against understitching—that is, an insertion while a warp thread is still in a wrong position, which results in a weaving fault—is significantly increased. Even more significant is the advantage for a stitching weaving loom comprising, for example, a reed hook for the insertion of additional threads. In such a stitching weaving loom, the stitching needle must be immersed into the lower shed before the weft needle inserts into the shed. Since the immersion movement of the stitching needle is very time-critical (high accelerations), a delayed insertion of the weft needle allows for higher speeds.

Figure 15K:
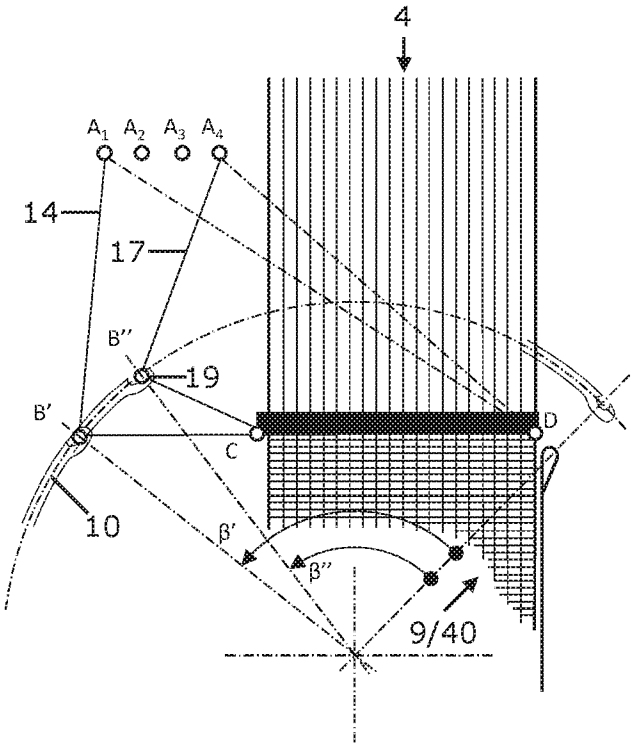
FIG. 15*a-n* a weft thread insertion unit with a device for a weft thread change in various process states, FIG. 16*a-e* a weft thread insertion unit which is adapted for wide/narrow weaving of ribbons.
Figure 15N:
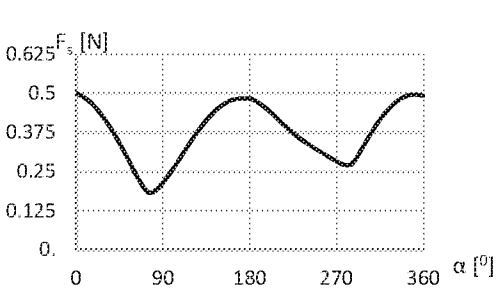
Figure 15J:
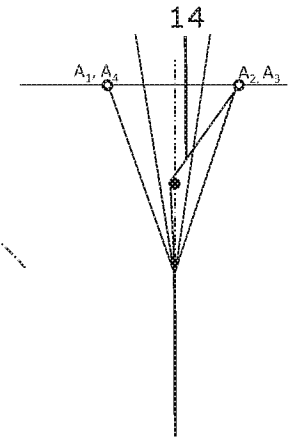
Figure 15M:
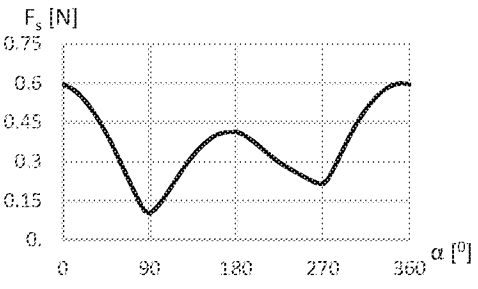
Figure 15I:
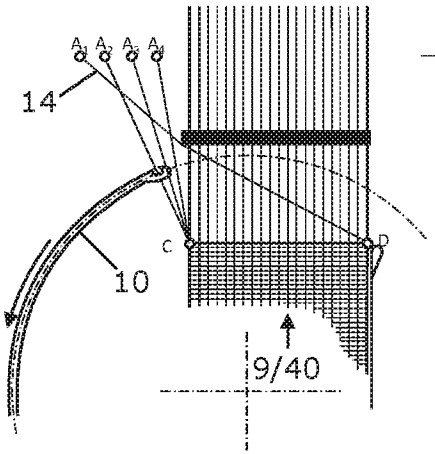
Figure 15L:
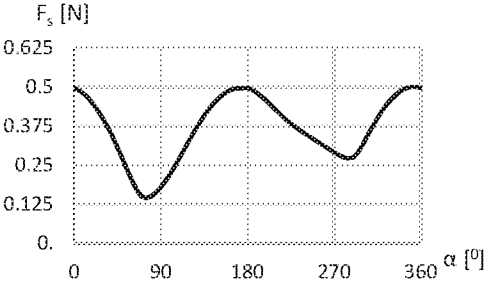

As a further application example, the weft thread change will be explained with reference to FIGS. 15*a* to 15*n*. Thereby, FIGS. 15*a*, 15*c*, 15*e*, 15*g*, 15*i* and 15*k* show each one of the weft thread situations from above and FIGS. 15*b*, 15*d*, 15*f*, 15*h* and 15 show each one of the weft thread situations from the side, while FIGS. 15*l-n* show the corresponding thread tension over the phase angle of the weaving loom. FIGS. 15*a* to *g* show a weft thread change from the weft thread of the thread guide (eye) A1 to a weft thread of the thread guide A2. In the FIGS. 15*a* and *b*, the thread guide A1 is in the high position and remains in this position as long as the weft thread 14 shall be inserted. In the FIGS. 15*c* and *d*, the weft thread 14 remains in the weft needle fork 19 when the latter crosses the line segment A1-D, since it is pulled into the fork as long as the thread guide A1 remains in the high position. In the FIGS. 15*e* and *f*, there is shown that—as soon as the weft needle fork 19 moving out of the shed 8 has crossed the line segment A2-C—the thread guides A3 and A4 change from high to low position and from low to high position, respectively. Thus, the corresponding weft threads 15 and 17 are not inserted into the weft needle, but rather are incorporated into the left ribbon edge as «normal» warp threads. The thread guide A2 remains in the low position because it shall insert the weft thread No 2 into the weft needle fork in the next cycle. The FIGS. 15*g* and *h* show that the thread guide A1 moves from high to low position when the weft needle starts its backward movement. As soon as the weft needle fork crosses the line segment A1-D, the weft thread 14 drops, therefore, out of the fork into the lower shed. The thread guide A2 moves from the low to high position at the same time. However, the weft thread 15 is not inserted into the weft needle fork, but grinds along the back of the weft needle which is moving out of the shed. In the FIGS. 15*i* and *j*, there is shown that—as soon as the weft needle fork crosses the line segment A2-C, the weft thread 15 jumps into the weft needle fork 19 and is inserted into the shed during the next cycle. The tension situation will now be explained with reference to FIG. 15*k* (change from thread 14 to thread 17). Thereby, it is crucial that, on the one hand, the minimum tension does not fall below a specific value (not below 0.2 N in the present example) because otherwise a weaving fault would result and, on the other hand, may not rise above a specific value (not over 0.5 N) because otherwise the thread tension would simply be too high and a tear-off would result. In FIG. 15*l*, the weft thread 14 is inserted from the thread guide A1, the weft needle pivot angle is β'; the weft thread tension is in the acceptable (healthy) range. In FIG. 15*m*, there is shown a situation which can and should be avoided by the invention. The weft thread 17 from the thread guide A4 is inserted, and the weft needle pivot angle would be β' without the measures of the invention. The weft thread tension is too fluctuating and, furthermore, the weft thread tension at the reed beat-up is larger than intended. By virtue of the measures of the invention according to FIG. 15*n*—when the weft thread 17 from the thread guide A4 is inserted—the weft needle pivot angle is reduced to β". As a result, the weft thread tension is back in the acceptable (healthy) range.

Figure 16C:
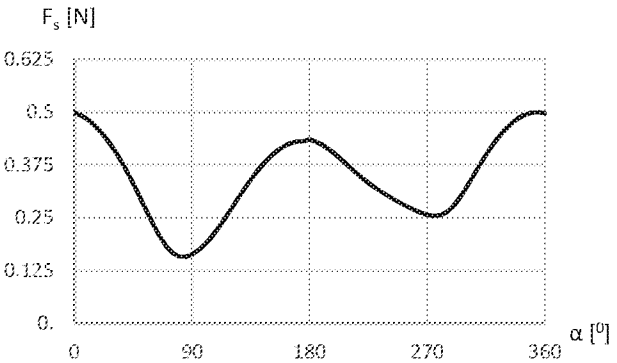
Figure 16D:
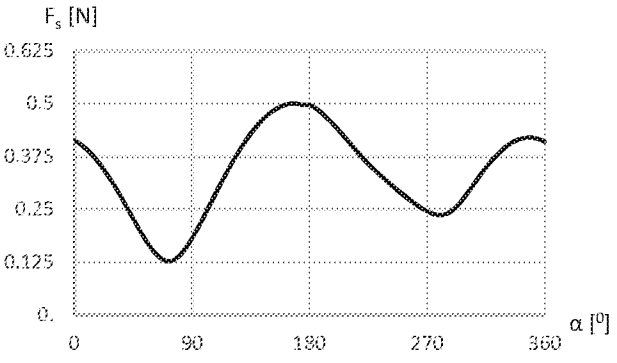
Figure 16E:
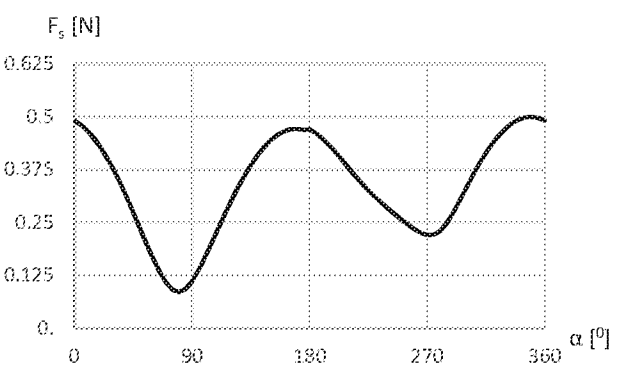
Figure 16A:
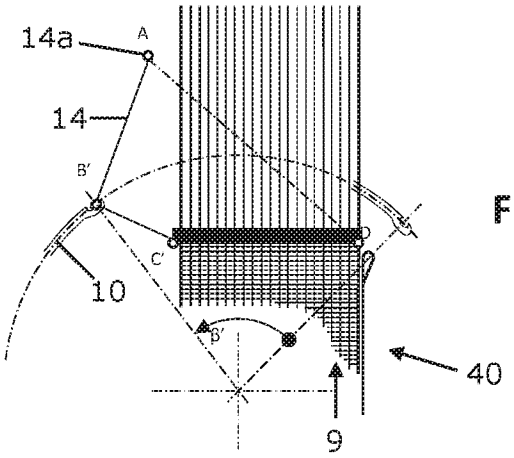
Figure 16B:
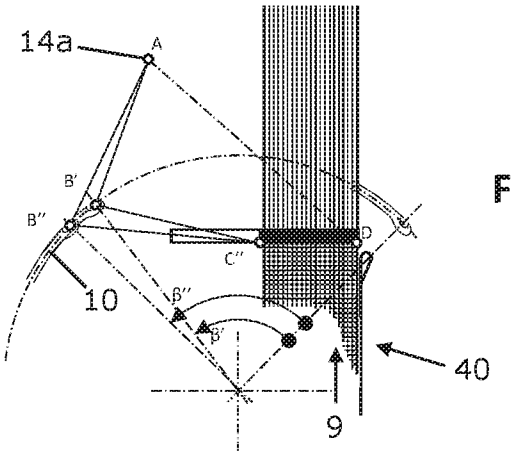

The further application example for the present invention is explained in the FIG. 16*a*. In FIG. 16*a* the weaving point is shown in a "wide" ribbon, while in FIG. 16*b* the weaving of a narrow ribbon is shown. In this case—just for the sake of a simplified representation—the ribbon is reduced only on one side—the left side. However, this has no influence on the principal problems and on the solution of these problems by means of the present invention. FIG. 16*c* shows the starting situation (FIG. 16*a*) of the wide ribbon with respect to the thread tension. The weft needle pivot angle is β' and the weft thread tension is in the acceptable (healthy) range. Without the measures of the invention, the situation according to FIG. 16*d* would occur upon transition to the narrower band. The ribbon is narrow when the weft needle pivot angle remains β', then the weft thread tension is considerably smaller at the reed beat-up. By means of the measures of the invention, the situation according to FIG. 16*e* can now be achieved. The ribbon is narrow, the weft needle pivot angle is increased to β". Thus, the weft thread tension at the reed beat-up has again the same amount as in the wide ribbon.

Figure 17:
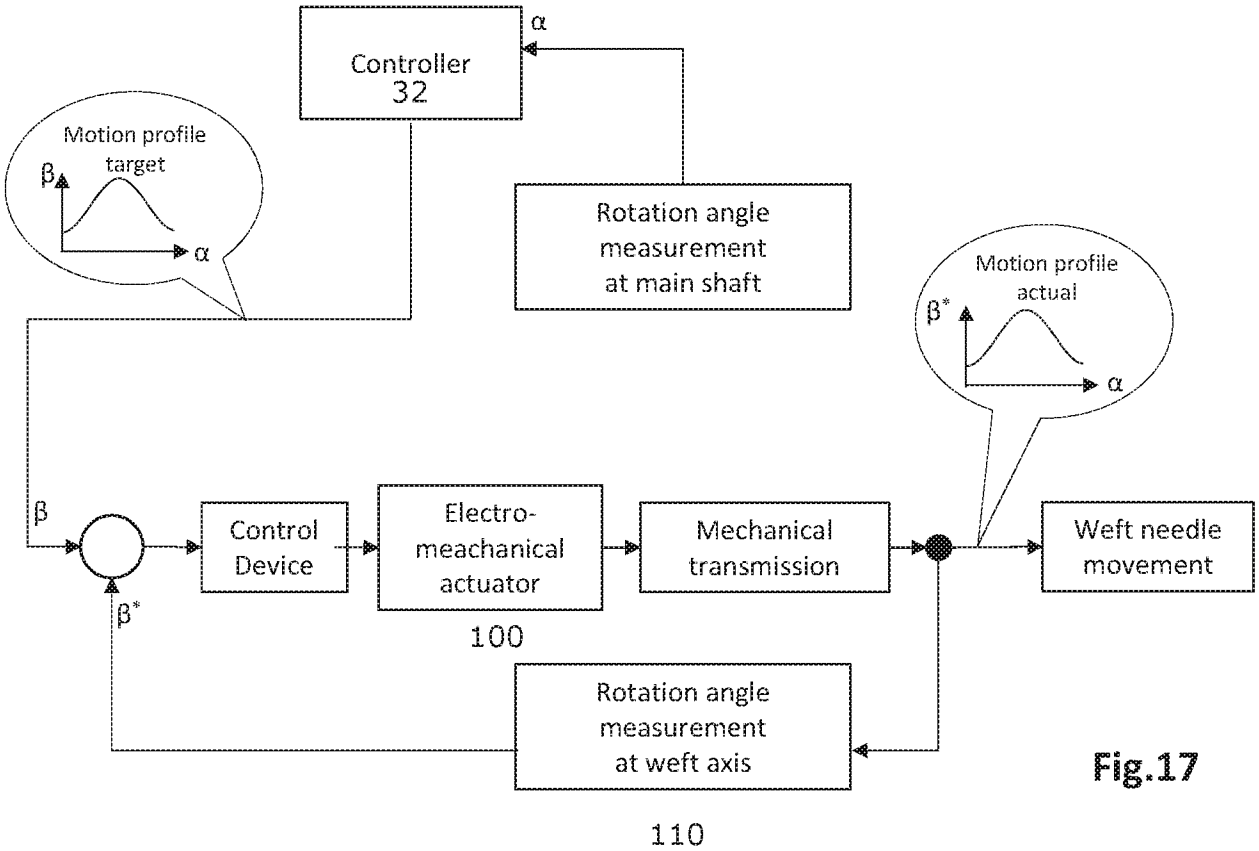
FIG. 17 the control loop of a weft thread insertion unit with a controlled actuator.

In principle, a continuous safe operation could be guaranteed with a stepper motor in the actuator 30 or 30*a*, but with a servo motor it seems reasonable to ensure that the control and thus the motion of the weft thread insertion needle remain in the desired phase. This can be ensured with a control—as shown in FIG. 17—although such control can also be reasonable with a stepper motor so that the step does not get out of tact. For this purpose, a rotational angle measurement by means of a sensor (rotation angle measuring device 110) is required, the measured value of which can then be used for the feedback in the control loop 100. As can be seen from FIG. 17, for this purpose a corresponding control device 32 is provided. As a result, the target motion profile of the weft thread insertion needle—taken e.g. from the main shaft—is compared with the actual motion profile and readjusted. A simple first order controller—in this case a digital one—can be used.

Of course, the possibilities to optimize the ribbon needle weaving loom by means of control do not end here. For example, it is possible to optimize the weaving speed by selecting, for example, the delay Δα (FIGS. 14*a* and 14*b*) in such manner that no warp thread is currently in the wrong position at the beginning of the insertion.

LIST OF REFERENCE NUMERALS

4 warp threads
8 shed
9 woven material
10 weft thread insertion needles
10*a* thread receiving at the weft thread insertion needle
10*b* last weft thread loop
11 axis of the weft thread insertion needle
14 weft thread and 1st weft thread, respectively
14*a* thread guiding eye
15 2nd weft thread
16 3rd weft thread
17 4th weft thread
18 weft thread transport
18*a* weft thread eye
18*b* weft thread tension spring
19 weft needle fork
20 reed
30 rotary actuator
30*a* linear actuator
32 control device
34 band or pulley drive
36 crank drive
38 pushrod
40 band with variable width
50 restoring spring arrangement
52 restoring spring
54 restoring spring
100 control loop
110 rotation angle measuring device
A1 weft thread guide 1st weft thread
A2 weft thread guide 2nd weft thread
A3 weft thread guide 3rd weft thread
A4 weft thread guide 4th weft thread

The invention claimed is:

1. A ribbon needle weaving loom comprising a weaving point, at which warp threads are interweavable to each other by means of at least one weft thread, a device for feeding the warp threads, a device for feeding the at least one weft thread, further comprising a shed forming device for forming a shed from the warp threads, further comprising at least one weft thread insertion needle for inserting a weft thread loop into the shed, and comprising a reed for stopping the weft thread loop, wherein an electromechanic actuator for driving the weft thread insertion needle and a control device are provided, characterized in that the actuator is configured in such manner as to allow preselection, by means of said control device, of at least one of the following measures:

the end position of the weft thread insertion needle at weft-insertion and of the position with retracted weft-insertion needle, the starting time point of the motion of the wet-Insertion needle and the instantaneous speed of the motion of the weft-insertion needle, at least within a certain range, wherein said electromechanic actuator is configured as rotary actuator such as a servo motor or a stepper motor, and, further characterized in that the weft thread insertion needle is firmly connected to the axis of the rotary actuator.

2. The ribbon needle weaving loom according to claim 1, characterized in that the weft insertion needle is connected to the axis of the rotary actuator through a band or pulley drive or a crank drive.

3. A ribbon needle weaving loom comprising a weaving point, at which warp threads are interweavable to each other by means of at least one weft thread, a device for feeding the warp threads, a device for feeding the at least one weft thread, further comprising a shed forming device for forming a shed from the warp threads, further comprising at least one weft thread insertion needle for inserting a weft thread loop into the shed, and comprising a reed for stopping the weft thread loop, wherein an electromechanic actuator for driving the weft thread insertion needle and a control device are provided, characterized in that the actuator is configured in such manner as to allow preselection, by means of said control device, of at least one of the following measures:

the end position of the weft thread insertion needle at weft-insertion and of the position with retracted weft-insertion needle, the starting time point of the motion of the weft-insertion needle and the instantaneous speed of the motion of the weft insertion needle, at least within a certain range, wherein said electromechanic actuator is configured as a linear actuator; and, further characterized in that the weft thread insertion needle is fixedly connected to the lifting axis of the linear actuator.

4. The ribbon needle weaving loom according to claim 3, characterized in that the weft thread insertion needle is connected to the linear actuator through a band or pulley drive, a pushrod, a pinion or a lever drive.

5. A ribbon needle weaving loom comprising a weaving point, at which warp threads are interweavable to each other by means of at least one weft thread, a device for feeding the warp threads, a device for feeding the at least one weft thread, further comprising a shed forming device for forming a shed from the warp threads, further comprising at least one weft thread insertion needle for inserting a weft thread loop into the shed, and comprising a reed for stopping the weft thread loop, wherein an electromechanic actuator for driving the weft thread insertion needle and a control device are provided, characterized in that the actuator is configured in such manner as to allow preselection, by means of said control device, of at least one of the following measures:

the end position of the weft thread insertion needle at weft-insertion and of the position with retracted weft-insertion needle, the starting time point of the motion of the weft-insertion needle and the instantaneous speed of the motion of the weft-insertion needle, at least within a certain range, wherein said electromechanic actuator is configured as rotary actuator such as a servo motor or a stepper motor; and, further characterized in that the actuator and the weft thread insertion needle form, together with a restoring spring arrangement, a spring/mass system.

6. The ribbon needle weaving loom according to claim 1, characterized in that the weaving loom is equipped with means for producing a ribbon with varying width.

7. The ribbon needle weaving loom according to claim 1, characterized in that the weaving loom is configured in such manner that the weft thread insertion needle is equipped with means for receiving and depositing weft threads of various type.

8. The ribbon needle weaving loom according to claim 1, characterized in that the weaving loom is configured in such manner that additional threads, such as effect threads or antenna threads, are introducible by means of a reed hook or a substantially equivalent means into the woven material and that the control device is configured in such manner that the weft thread insertion needle and the reed hook or the substantially equivalent means remain unaffected by the weft thread insertion needle.

9. The ribbon needle weaving loom according to claim 1, characterized in that the control device is part of a control loop, wherein a rotation angle measuring device is provided at the axis of the weft thread insertion needle, which provides comparison with a target rotation angle and is used to control the actuator.

10. A ribbon needle weaving loom comprising a weaving point, at which warp threads are interweavable to each other by means of at least one weft thread, a device for feeding the warp threads, a device for feeding the at least one weft thread, further comprising a shed forming device for forming a shed from the warp threads, further comprising at least one weft thread insertion needle for inserting a weft thread loop into the shed, and comprising a reed for stopping the weft thread loop, wherein an electromechanic actuator for driving the weft thread insertion needle and a control device are provided, characterized in that the actuator is configured in such manner as to allow preselection, by means of said control device, of at least one of the following measures;

the end position of the weft thread insertion needle at weft-insertion and of the position with retracted weft-insertion needle, the starting time point of the motion of the weft-insertion needle and the instantaneous speed of the motion of the weft-insertion needle, at least within a certain range, wherein said electromechanic actuator is configured as a linear actuator; and, further characterized in that the actuator and the weft thread insertion needle form, together with a restoring spring arrangement, a spring/mass system.

11. The ribbon needle weaving loom according to claim 3, characterized in that the weaving loom is equipped with means for producing a ribbon with varying width.

12. The ribbon needle weaving loom according to claim 3, characterized in that the weaving loom is configured in such manner that the weft thread insertion needle is equipped with means for receiving and depositing weft threads of various type.

* * * * *